US008742991B2

(12) United States Patent
Soora

(10) Patent No.: US 8,742,991 B2
(45) Date of Patent: Jun. 3, 2014

(54) HANDHELD ELECTRONIC DEVICES AND METHODS INVOLVING TUNABLE DIELECTRIC MATERIALS

(75) Inventor: Shruthi Soora, Raleigh, NC (US)

(73) Assignee: HTC Corporation, Taoyuan, Taoyuan County (TW)

( * ) Notice: Subject to any disclaimer, the term of this patent is extended or adjusted under 35 U.S.C. 154(b) by 308 days.

(21) Appl. No.: 13/443,007

(22) Filed: Apr. 10, 2012

(65) Prior Publication Data

US 2013/0265202 A1 Oct. 10, 2013

(51) Int. Cl.
*H01Q 1/38* (2006.01)
*H01Q 1/24* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 2002/0050828 | A1* | 5/2002 | Seward et al. | 324/652 |
| 2004/0207567 | A1* | 10/2004 | Sievenpiper et al. | 343/911 R |
| 2010/0201465 | A1* | 8/2010 | McKinzie, III | 333/251 |
| 2013/0063158 | A1* | 3/2013 | Potrepka et al. | 324/636 |
| 2013/0240241 | A1* | 9/2013 | Dubrow et al. | 174/113 R |

* cited by examiner

*Primary Examiner* — Hoanganh Le
(74) *Attorney, Agent, or Firm* — McClure, Qualey & Rodack, LLP

(57) ABSTRACT

Handheld electronic devices and methods involving tunable dielectric materials are provided. In this regard, a representative device includes: a transceiver operative to selectively transmit and receive electrical signals; an antenna assembly electrically connected to the transceiver, the antenna assembly having anisotropic dielectric material operative to exhibit a change in dielectric constant responsive to an applied electrical signal; and a dielectric tuning system operative to automatically and selectively apply a first signal to the antenna assembly to change the dielectric constant of the anisotropic dielectric material to alter a resonant frequency and efficiency tuning of the antenna.

20 Claims, 4 Drawing Sheets

HANDHELD ELECTRONIC DEVICES AND METHODS INVOLVING TUNABLE DIELECTRIC MATERIALS

TECHNICAL FIELD

The present disclosure generally relates to handheld electronic devices.

BACKGROUND

Handheld electronic devices such as smartphones include antennas for facilitating communication. Notably, these antennas are sensitive to environmental conditions that can affect antenna performance. For example, the return loss of an antenna of a device can change when the device is moved from the hand of a user to being positioned on a table.

SUMMARY

Handheld electronic devices and methods involving tunable dielectric materials are provided. Briefly described, one embodiment, among others, is a handheld electronic device comprising: a transceiver operative to selectively transmit and receive signals; an antenna assembly electrically connected to the transceiver, the antenna assembly having anisotropic dielectric material operative to exhibit a change in dielectric constant responsive to an applied electrical signal; and a dielectric tuning system operative to automatically and selectively apply a first signal to the antenna assembly to change the dielectric constant of the anisotropic dielectric material to alter a resonant frequency and efficiency tuning of the antenna.

Another embodiment is a method for tuning an antenna of a handheld electronic device comprising: selectively changing the dielectric constant of an anisotropic dielectric material of an antenna assembly of a handheld electronic device such that a resonant frequency and efficiency tuning of an antenna of the antenna assembly are altered.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
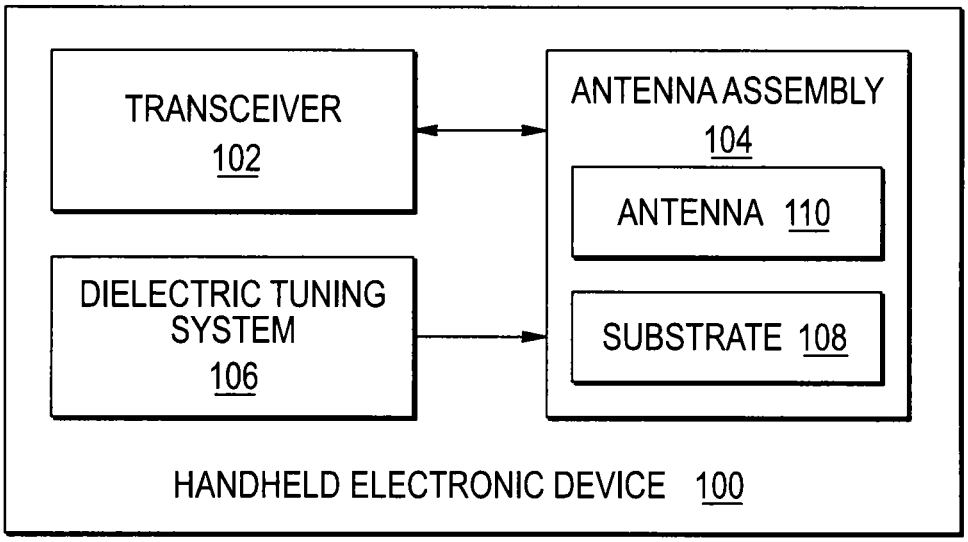
FIG. 1 is a schematic diagram of an example embodiment of a handheld electronic device.

Having summarized various aspects of the present disclosure, reference will now be made in detail to that which is illustrated in the drawings. While the disclosure will be described in connection with these drawings, there is no intent to limit the scope of legal protection to the embodiment or embodiments disclosed herein. Rather, the intent is to cover all alternatives, modifications and equivalents included within the spirit and scope of the disclosure as defined by the appended claims.

In this regard, FIG. 1 is a schematic diagram of an example embodiment of a handheld electronic device (such as a mobile phone, a tablet computer). As shown in FIG. 1, device 100 includes a transceiver 102, an antenna assembly 104 and a dielectric tuning system 106. The antenna assembly is electrically connected to the transceiver and includes an anisotropic dielectric material. In this embodiment, the antenna assembly incorporates a substrate 108, which is formed at least in part by the anisotropic dielectric material, and an antenna 110 (e.g., a PIFA, patch or monopole antenna) that is located near the substrate (e.g., antenna is disposed/coated on an antenna carrier or supported by the substrate, wherein the carrier is adjacent to the substrate). The structure of the antenna may be any type in which the resonant frequency and efficiency depend on the dielectric properties (E-field based), e.g., where the antenna resonant frequency and efficiency peak may be tuned by modifying the dielectric constant of the substrate. It should also be noted that, in this context, being located near the substrate means that the antenna carrier or antenna itself is close enough to the substrate to exhibit a change in performance characteristics responsive to a change in the dielectric constant of the anisotropic dielectric material.

The anisotropic dielectric material of the substrate exhibits a change in dielectric constant responsive to an applied electrical signal. Specifically, in this embodiment, the molecular orientation of the material changes responsive to the application of voltage. In some embodiments, the range of dielectric constants that can be exhibited by a material may be rather small, whereas other materials may exhibit a wider range of dielectric constants. More information regarding such materials can be found in various publications such as Liu, L.; Langley, R .J.; , "Liquid crystal tunable microstrip patch antenna," Electronics Letters , vol. 44, no. 20, pp. 1179-1180, Sep. 25, 2008; Lee, H. J.; Liu, L.; Ford, K. L.; Langley, R. J.; , "Reconfigurable antennas and band gap materials," Cognitive Radio and Software Defined Radios: Technologies and Techniques, 2008 IET Seminar on, vol., no., pp. 1-5, 18-18 Sep. 2008; and, Moessinger, A.; Dieter, S.; Jakoby, R.; Menzel, W.; Mueller, S.; , "Reconfigurable LC-reflectarray setup and characterisation," Antennas and Propagation, 2009. EuCAP 2009. 3rd European Conference, vol., no., pp. 2761-2765, 23-27 Mar. 2009, each of which is incorporated herein by reference.

In operation, the transceiver selectively transmits and receives signals via the antenna assembly, which exhibits various performance characteristics (e.g., a resonant frequency and efficiency tuning). The dielectric tuning system, which can be embodied in hardware, software or a combination thereof, selectively applies a voltage to the antenna assembly (e.g., to the substrate) based on one or more of various criteria to change the dielectric constant of the anisotropic dielectric material. By changing the dielectric constant, the resonant frequency and efficiency tuning of the antenna are altered to better respond to the current environmental conditions being experienced by the antenna. It should be noted that the tuning of the dielectric is not limited to responsiveness to voltage signals. For instance, in some embodiment, tuning may be accomplished by altering current. Additionally, either certain parts of the antenna substrate may be altered or the entire antenna substrate. Alternate approaches to tuning may involve reconfigurable antennas using switches and tunable lumped element components, among others.

Figure 2A:
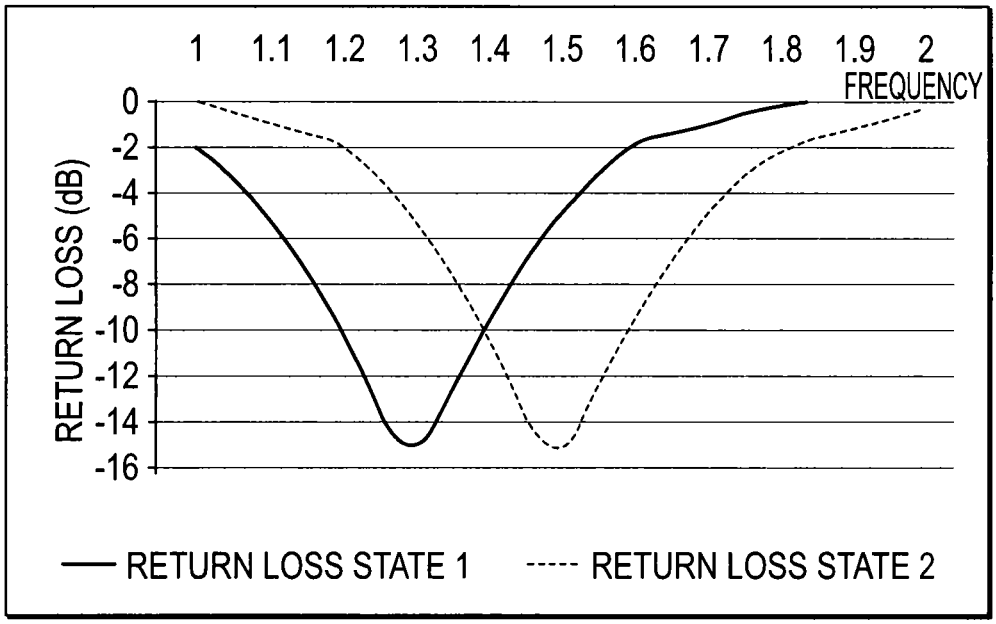
FIGS. 2A and 2B are graphs depicting performance characteristics of the antenna of the embodiment of FIG. 1.
Figure 2B:
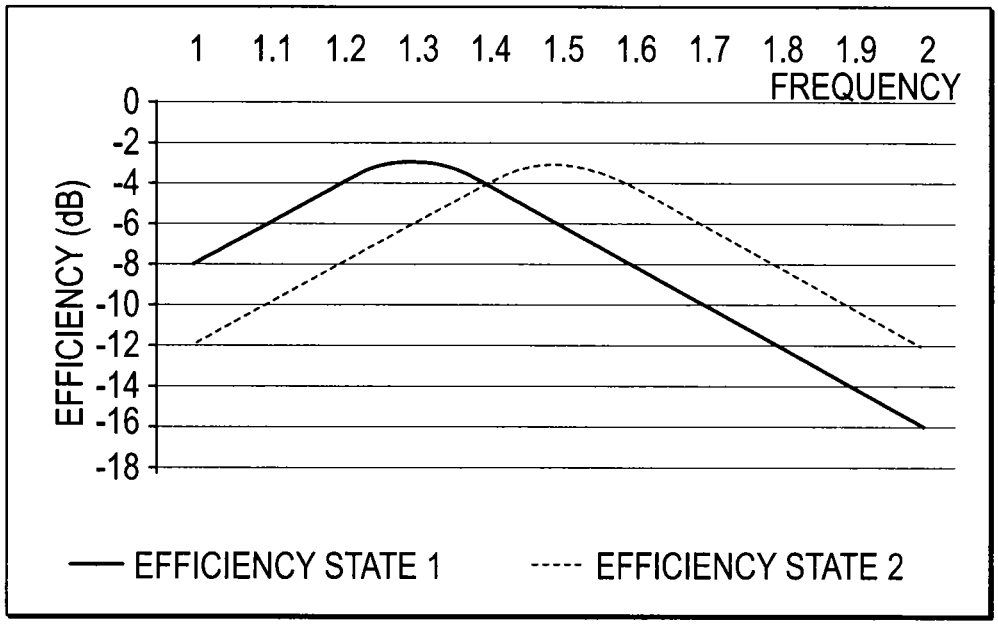

FIGS. 2A and 2B are graphs depicting performance characteristics of the antenna of the embodiment of FIG. 1. As shown in FIG. 2A, which is a graph of return loss (dB) versus frequency, changing of the dielectric constant between state 1 (in which no voltage is applied) and state 2 (in which an arbitrary voltage is applied) results in a shift of the return loss with respect to frequency. Further, as shown in FIG. 2B, which is a graph of efficiency (dB) versus frequency, changing of the dielectric constant also results in the efficiency shifting with respect to frequency. Notably, antenna tuning via tunable circuits is known to tune return loss only. Thus, the changing of a dielectric constant of an antenna assembly may preserve the ability of an antenna to maintain efficiency while adapting to changing environmental conditions.

Figure 3:
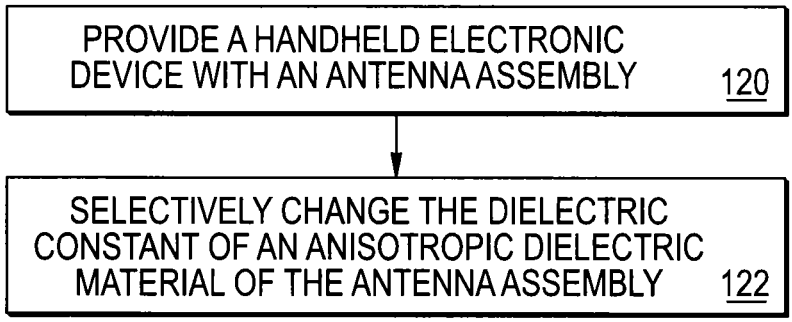
FIG. 3 is a flowchart depicting an example embodiment of a method for tuning an antenna of a handheld electronic device.

FIG. 3 is a flowchart depicting an example embodiment of a method for tuning an antenna of a handheld electronic device. As shown in FIG. 3, the method may be construed as beginning at block 120, in which a handheld electronic device with an antenna assembly is provided. In block 122, the dielectric constant of an anisotropic dielectric material of the antenna assembly is selectively changed. As noted above, such a change alters the return loss and efficiency tuning of the antenna assembly. It should also be noted that such tuning can be performed along a range of dielectric constants that may be exhibited by the antenna assembly.

Figure 4:
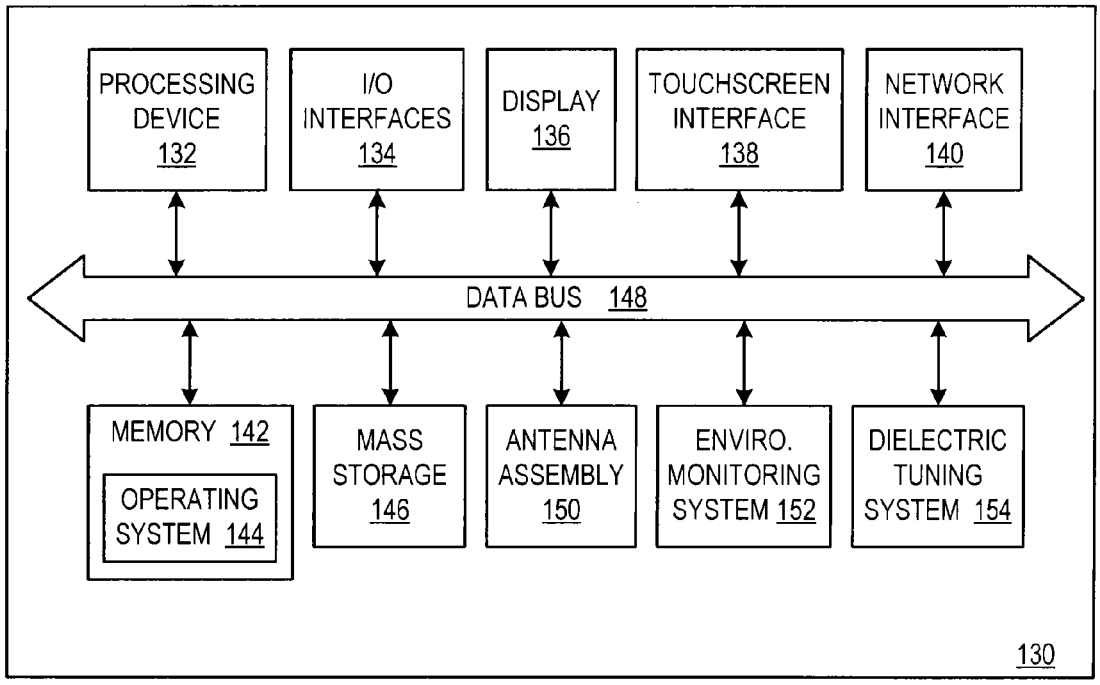
FIG. 4 is a schematic diagram of another example embodiment of a handheld electronic device.

FIG. 4 is a schematic diagram of another example embodiment of a handheld electronic device. As shown in FIG. 4, device 130 is configured as a smartphone or a tablet computer that includes a processing device (processor) 132, input/output interfaces 134, a display 136, a touchscreen interface 138, a network/connectivity interface 140, a memory 142, an operating system 144, a mass storage 146, each communicating across a local data bus 148. Additionally, device 130 incorporates an antenna assembly 150, an environmental monitoring system 152 and a dielectric tuning system 154. Note that the locations and configurations of these systems and components can vary among embodiments.

The processing device 132 may include any custom made or commercially available processor, a central processing unit (CPU) or an auxiliary processor among several processors associated with the device 130, a semiconductor based microprocessor (in the form of a microchip), a macroprocessor, one or more application specific integrated circuits (ASICs), a plurality of suitably configured digital logic gates, and other electrical configurations comprising discrete elements both individually and in various combinations to coordinate the overall operation of the system.

The memory 142 can include any one of a combination of volatile memory elements (e.g., random-access memory (RAM, such as DRAM, and SRAM, etc.)) and nonvolatile memory elements. The memory typically comprises native operating system 144, one or more native applications, emulation systems, or emulated applications for any of a variety of operating systems and/or emulated hardware platforms, emulated operating systems, etc. For example, the applications may include application specific software which may comprise some or all the components of the device. In accordance with such embodiments, the components are stored in memory and executed by the processing device.

Touchscreen interface 138 is configured to detect contact within the display area of the display 136 and provides such functionality as on-screen buttons, menus, keyboards, softkeys, etc. that allows users to navigate user interfaces by touch.

One of ordinary skill in the art will appreciate that the memory 142 can, and typically will, comprise other components which have been omitted for purposes of brevity. Note that in the context of this disclosure, a non-transitory computer-readable medium stores one or more programs for use by or in connection with an instruction execution system, apparatus, or device.

With further reference to FIG. 4, network/connectivity interface device 140 comprises various components used to transmit and/or receive data over a networked environment. When such components are embodied as an application, the one or more components may be stored on a non-transitory computer-readable medium and executed by the processing device.

With respect to the operation of device 130, antenna assembly 150 incorporates an anisotropic dielectric material. Dielectric tuning system 154 automatically and selectively applies a first voltage to antenna assembly 150 to change the dielectric constant of the anisotropic dielectric material from a first state to a second state. This may be accomplished by a switch controlled circuit or other means for selectively applying, in this embodiment, a voltage to the anisotropic dielectric material. As mentioned before, this alters a resonant frequency and efficiency tuning of the antenna. Notably, change of the dielectric constant is accomplished responsive to environment monitoring system 152, which determines a change in operating environment of the antenna assembly of the device. Representative functionality associated with a dielectric tuning system and an environment monitoring system, each of which may be implemented in hardware, software or combinations thereof, is depicted in FIG. 5.

If embodied in software, it should be noted that each block depicted in the flowcharts may represent a module, segment, or portion of code that comprises program instructions stored on a non-transitory computer readable medium to implement the specified logical function(s). In this regard, the program instructions may be embodied in the form of source code that comprises statements written in a programming language or machine code that comprises numerical instructions recognizable by a suitable execution system. The machine code may be converted from the source code, etc. If embodied in hardware, each block may represent a circuit or a number of interconnected circuits to implement the specified logical function(s). Additionally, although the flowcharts show specific orders of execution, it is to be understood that the orders of execution may differ.

Figure 5:
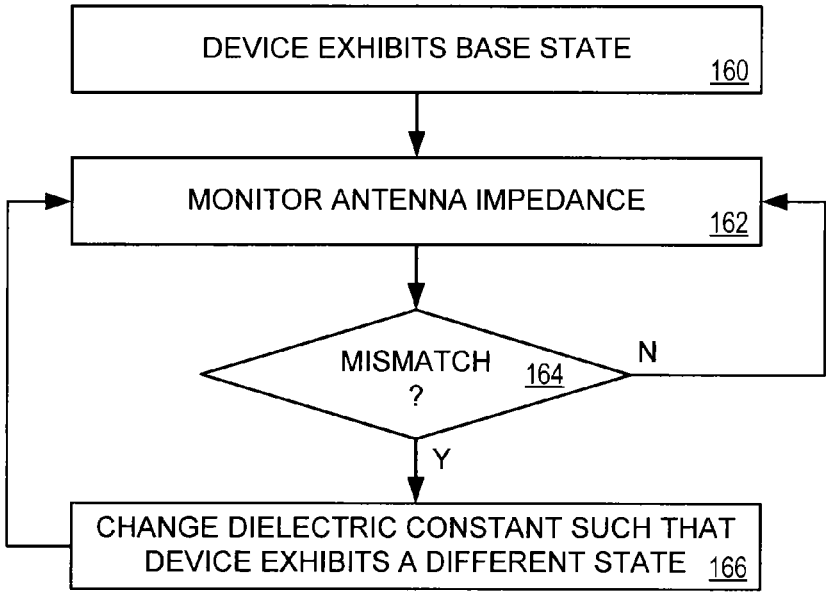
FIG. 5 is a flowchart depicting another example embodiment of a method for tuning an antenna of a handheld electronic device.

In this regard, FIG. 5 is a flowchart depicting another example embodiment of a method for tuning an antenna of a handheld electronic device. As shown in FIG. 5, the method may be construed as beginning at block 160, in which a handheld device exhibits a first state. In block 162, antenna impedance is monitored, such as by periodically polling the antenna.

In this regard, in some embodiments, antenna impedance may be monitored by a coupler at the antenna switch, for example. By storing and sensing a change in the input impedance, it is possible to detect a change or detune of the antenna. The complex impedance may be calculated from the forward (power to the antenna) and the reverse (power to the radio powers) and IQ demodulated. An impedance polling method may determine a change in state by comparing the forward and reverse powers. When IQ demodulated, it is possible to determine the impedance location on the Smith chart and the amount of mismatch. In other embodiments, other techniques such as alternate closed or open loop tuning approaches may be used.

In block 164, a determination is made as to whether the impedance of the antenna is mismatched. If it is determined that no mismatch, based on environmental conditions exists (or if the mismatch is less than a predetermined threshold), the process returns to block 162. However, if it is determined that a mismatch corresponds to a predetermined threshold, the process may proceed to block 166, in which the dielectric constant is changed so that the antenna exhibits a different (e.g., an alternate) state with associated changes in return loss and efficiency tuning. In those embodiments that are configured to exhibit dielectric constants along a range of such constants, dynamic tuning of the antenna may be performed responsive to feedback provided by the monitoring function.

Figure 6:
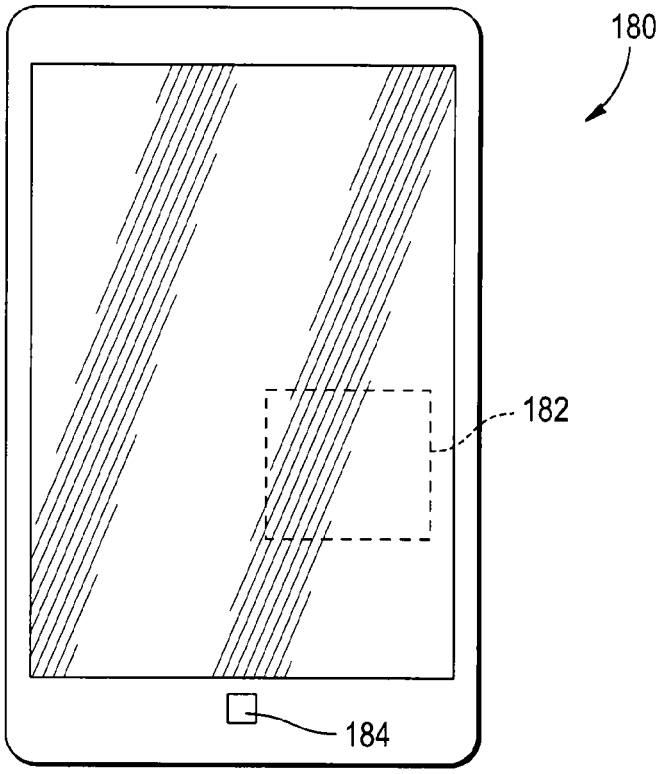
FIG. 6 is a schematic diagram of another example embodiment of a handheld electronic device.

FIG. 6 is a schematic diagram of another example embodiment of a handheld electronic device 180. In this embodiment, device 180 is configured as a smartphone that includes a transceiver, an antenna assembly and a dielectric tuning system, although these additional features are not depicted. The antenna assembly is electrically connected to the transceiver and includes an anisotropic dielectric material. Notably, in FIG. 6, the device is assumed to be remote from a user (e.g., placed on a table top) and, as such, the dielectric material is conditioned to exhibit a first dielectric constant associated with the current environment of the antenna.

Device 180 also includes an environment monitoring system 182 that incorporates a sensor 184. In this embodiment, the sensor is a proximity sensor that is used to determine the proximity of a user to the device. For instance, the sensor may be used to determine whether a user's face is positioned against the front of the device (i.e., the side that incorporates the display), such as would occur during a phone conversation, or whether the phone is in proximity to the user, such as when viewing the display. In other embodiments, other types of sensors may be used for detecting environmental changes, such as a change associated with whether the device is being held by the user.

Information corresponding to the proximity of the user may be used to influence the setting of the dielectric constant of the antenna assembly. By way of example, this information may be used as an input (e.g., singularly or in combination with one or more other inputs) to the environment monitoring system for use by the system in determining whether and/or to what extent a change in dielectric constant should be made.

Figure 7:
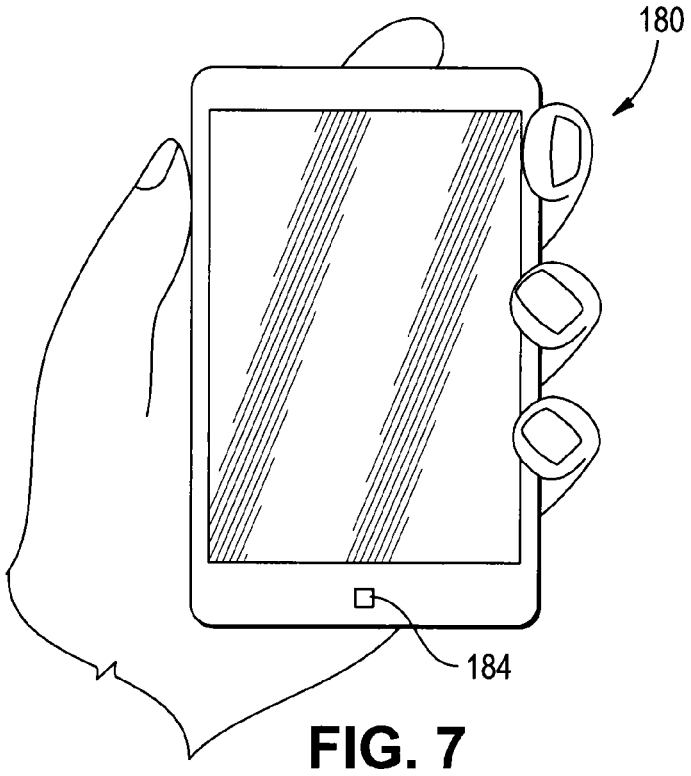
FIG. 7 is a schematic diagram of the device of FIG. 6 exposed to a change of environment.

FIG. 7 is a schematic diagram of the device of FIG. 6 exposed to a change of environment. Specifically, the device is being grasped by a user. As noted before, a change of environment can affect the performance characteristics of the antenna to such an extent that the environment monitoring system may direct a change in the dielectric constant via the dielectric tuning system.

Thereafter, as the device is moved toward the face of the user, the proximity sensor provides input to the environment monitoring system, which may direct a further change in the dielectric constant via the dielectric tuning system. As such, dynamic changes in performance characteristics of an antenna may be achieved.

It should be noted that a proximity sensor is but one way to detect a change in antenna environment. Alternate sensing techniques such as capacitive, light, pressure and/or temperature monitoring, among others, may be used to detect environment or a human body. Furthermore, the sensor can be arranged on any proper place of the handheld device so that an environmental change can be sensed for initiating a corresponding change of the dielectric constant of the dielectric material.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

At least the following is claimed:

1. A handheld electronic device comprising:

a transceiver operative to selectively transmit and receive signals;

an antenna assembly electrically connected to the transceiver, the antenna assembly having anisotropic dielectric material operative to exhibit a change in dielectric constant responsive to an applied electrical signal; and a dielectric tuning system operative to automatically and selectively apply a first signal to the antenna assembly to change the dielectric constant of the anisotropic dielectric material to alter a resonant frequency and efficiency tuning of the antenna.

2. The device of claim 1, wherein:

the device further comprises an environment monitoring system operative to determine a change in operating environment of the antenna assembly and provide an output corresponding to the change; and the dielectric tuning system is further operative to apply the first signal to the antenna assembly responsive to the output.

3. The device of claim 2, wherein, in determining a change in operating environment, the environment monitoring system is operative to poll the antenna to identify impedance mismatch changes of the antenna.

4. The device of claim 2, wherein, in determining a change in operating environment, the environment monitoring system is operative to determine impedance of the antenna.

5. The device of claim 2, wherein the environment monitoring system further comprises a proximity sensor operative to determine proximity to a user of the device such that, responsive to determining proximity of the user, the environment monitoring system provides an output corresponding to predetermined change in the operating environment.

6. The device of claim 1, wherein:

the antenna assembly has a substrate near the antenna, the substrate being formed, at least in part, of the anisotropic dielectric material; and the dielectric tuning system is operative to apply the first signal to the substrate.

7. The device of claim 1, wherein the dielectric tuning system contains executable instructions executed by the processing device for enabling the first signal to be applied.

8. The device of claim 1, further comprising:

a display operative to display images; and a processing device operative to drive the display.

9. The device of claim 8, wherein the device is a smartphone or a tablet computer.

10. The device of claim 1, wherein the anisotropic dielectric material is operative to alternately exhibit two dielectric constants, a first of the dielectric constants being exhibited when the first signal is applied thereto, and a second of the dielectric constants being exhibited when the first signal is not applied.

11. The device of claim 1, wherein the anisotropic dielectric material is operative to exhibit dielectric constants from within a range of dielectric constants responsive to a corresponding voltage being applied thereto.

12. A method for tuning an antenna of a handheld electronic device comprising:

selectively changing the dielectric constant of an anisotropic dielectric material of an antenna assembly of a handheld electronic device such that a resonant frequency and efficiency tuning of an antenna of the antenna assembly are altered.

13. The method of claim 12, wherein selectively changing the dielectric constant comprises applying a signal to the anisotropic dielectric material.

14. The method of claim 13, wherein:

the antenna is located near a substrate formed, at least in part, of the anisotropic dielectric material; and selectively applying the signal comprises selectively apply a voltage to the substrate.

15. The method of claim 12, wherein:

the method further comprises monitoring an operating environment of the antenna assembly; and selectively changing the dielectric constant of an anisotropic dielectric material responsive to determining that a change in the operating environment corresponds to a predetermined threshold.

16. The method of claim 15, wherein monitoring the operating environment comprises determining the impedance of the antenna.

17. The method of claim 15, wherein monitoring the operating environment comprises polling the antenna to identify impedance mismatch changes of the antenna.

18. The method of claim 12, wherein selectively changing the dielectric constant comprises:

determining that a user of the handheld electronic device is holding the device; and selectively changing the dielectric constant to accommodate an impedance mismatch of the antenna associated with the holding of the device.

19. The method of claim 12, wherein selectively changing the dielectric constant comprises:

determining that a user of the handheld electronic device is not holding the device; and selectively changing the dielectric constant to accommodate an impedance mismatch of the antenna associated with the device not being held.

20. The method of claim 12, wherein selectively changing the dielectric constant comprises dynamically changing the dielectric constant responsive to monitored changes in the operating environment of the device.

* * * * *